United States Patent [19]

Werst

[11] 4,232,283

[45] Nov. 4, 1980

[54] ELECTRON BEAM MOVING APPARATUS FOR A COLOR CATHODE RAY TUBE

[75] Inventor: Joseph L. Werst, Lancaster, Pa.

[73] Assignee: RCA Corporation, New York, N.Y.

[21] Appl. No.: 24,392

[22] Filed: Mar. 27, 1979

[51] Int. Cl.[3] ..... H01J 29/51

[52] U.S. Cl. ..... 335/212; 313/412

[58] Field of Search ..... 335/212; 313/412, 428; 315/368

[56] References Cited

U.S. PATENT DOCUMENTS

| | | | |
|---|---|---|---|
| 2,717,323 | 9/1955 | Clay | 313/412 |
| 2,834,911 | 5/1958 | Nelson | 315/368 X |
| 3,290,532 | 12/1966 | Lemke et al. | 335/212 X |
| 3,793,602 | 2/1974 | Lister | 335/212 |
| 3,899,761 | 8/1975 | Yamauchi | 313/428 X |
| 3,942,146 | 3/1976 | LaBelle | 335/212 |

*Primary Examiner*—Malcolm F. Hubler

*Attorney, Agent, or Firm*—E. M. Whitacre; P. J. Rasmussen; J. J. Laks

[57] ABSTRACT

To provide static convergence correction motion to the outer beam of three in-line electron beams of a color cathode ray tube, a magnetized sphere is located adjacent each outer beam. Each sphere is magnetized across a diameter to produce, for example, a two-pole magnetic field for providing the correction motion. The two-poles are separated along a polar axis. Each sphere is located in a housing which permits rotation of the polar axis of the sphere into alignment with the longitudinal axis of the cathode ray tube and permits rotation of the polar axis out of longitudinal alignment in both horizontal and vertical planes.

7 Claims, 10 Drawing Figures

ELECTRON BEAM MOVING APPARATUS FOR A COLOR CATHODE RAY TUBE

BACKGROUND OF THE INVENTION

This invention relates to electron beam moving apparatus for a color cathode ray tube.

Color display systems, such as utilized in color television receivers, include a color cathode ray tube in which three electron beams are modulated by color-representative video signals. The beams impinge on respective color phosphor areas on the inside of the cathode ray tube viewing screen to reproduce a color scene as the beams are deflected to scan a raster. To accurately reproduce the color scene, the three beams must be substantially converged at the screen at all points on the raster. The beams may be converged at points away from the center of the raster by utilizing dynamic convergence methods or self-converging techniques, or a combintion of both. Regardless of the methods utilized to achieve convergence when the beams are deflected, provision must be made to statically converge the undeflected beams in the center region of the screen. Static convergence devices are necessary because the effect of tolerances in the manufacture of electron beam guns and their assembly into the cathode ray tube neck frequently results in a statically misconverged condition.

Some static convergence devices converge the outer beams of three in-line beams of a color cathode ray tube onto the central beam by means of four and six pole rotatable magnetic field ring pairs, producing opposite and like movements, respectively, of the outer beams, such as described in U.S. Pat. No. 3,725,831, by R. L. Barbin entitled "MAGNETIC BEAM ADJUSTING ARRANGEMENTS." Another static convergence device comprises a nonmechanically adjustabe strip or sheath of magnetic material placed about the neck of a color cathode ray tube, such as described in U.S. Pat. No. 4,138,628 by J. L. Smith entitled "MAGNETIZING METHOD FOR USE WITH A CATHODE RAY TUBE." The strip is magnetized to create permanently magnetized regions at appropriate locations and of appropriate polarities and field strengths to produce a static convergence magnetic field. After a color cathode ray tube is statically converged using a magnetized strip, for example, other set-up operations are performed and the catode ray tube is assembled or secured into the television receiver chassis.

After the static convergence operation has been performed, during the remainder of the cathode ray tube set-up or during subsequent television receiver operation, the electron beams may become slightly misconverged. It is desirable to provide a supplemental mechanically adjustable static convergence device to bring the electron beams back into convergence. Because only a small amount of supplemental beam motion is required, typical conventional prior art mechanically adjustable devices may not be sufficiently refined to provide only the small supplemental movements required.

With improved cathode ray tube manufacturing and assembly technique being developed, many tubes may require only a small amount of correcting beam motion, to begin with, to achieve static convergence. The aforementioned supplemental mechanically adjustable static convergence device may then be the only device necessary to achieve convergence. Such a device, if of compact design, may be ideally suited for short-necked cathode ray tubes that have little neck room available on which to mount a static convergence device.

SUMMARY OF THE INVENTION

To provide electron beam movement for an in-line electron beam color cathode ray tube, a magnetic field producing structure has at least two magnetic poles separated along a polar axis. A support housing locates the structure adjacent an outer in-line electron beam. A rotational arrangement secures the magnetic field producing structure to permit the polar axis to align with the longitudinal axis of the cathode ray tube and to permit the polar axis to be rotated out of longitudinal alignment in both horizontal and vertical planes.

DESCRIPTION OF THE INVENTION

Figure 1:
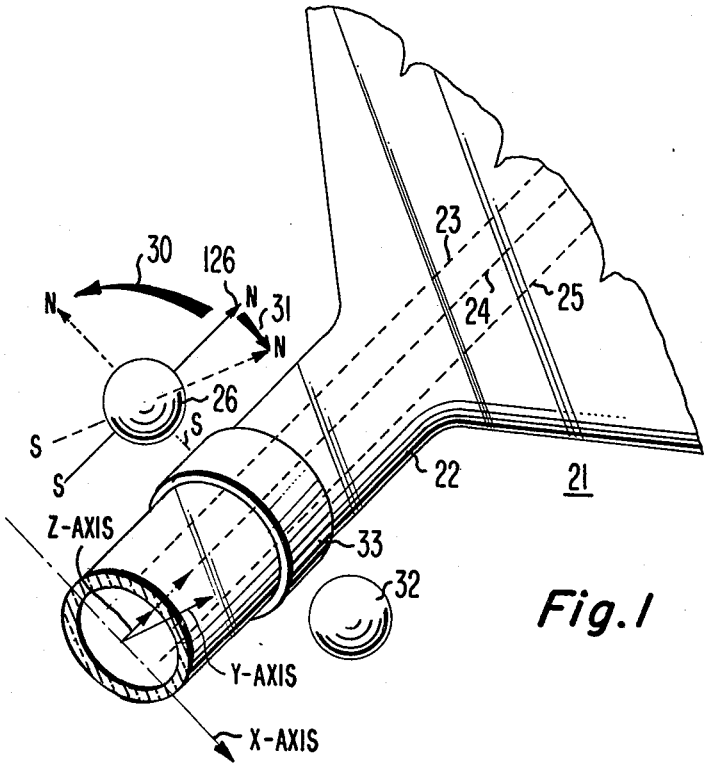
FIG. 1 illustrates the neck portion of an in-line color cathode ray tube, with two electron beam moving structures embodying the invention oriented in various rotational positions.

FIG. 1, schematically represents the neck portion 22 of a color cathode ray tube 21, with 3 in-line electron gun assemblies, not illustrated, producing 3 in-line electron beams 23–25. The electron beams are located within the cathode ray tube envelope and travel along the longitudinal or Z-axis of the tube from the neck region to the opposite flared end of the tube, not shown, where the electron beams impinge on the color phosphor screen. The longitudinal paths along which the 3 in-line electron beams travel are schematically illustrated by the longitudinal lines 23–25.

A nonmechanically adjustable strip or sheath 33 of a low permeability magnetic material is located about neck 22. In the strip are created permanently magnetized regions, the locations, polarities, and field strengths of the regions being selected to produce, in the region of electron beams 23–25, a static convergence and purity correcting magnetic field. Such a magnetized strip is fully described in the aforementioned U.S. patent of J. L. Smith.

If, for example, after assembly of the color cathode ray tube in the television receiver chassis a certain amount of misconvergence is reintroduced, a supplemental correcting motion may be provided by electron beam moving magnetic structures 26 and 32, embodying the invention, and schematically illustrated in FIG. 1 by a magnetized sphere 26 located adjacent outer electron beam 23 and by a magnetized sphere 32 located adjacent outer electron beam 25. Spheres 26 and 32 may be formed of a magnetic material such as barium ferrite mixed in an epoxy binder.

Figure 5:
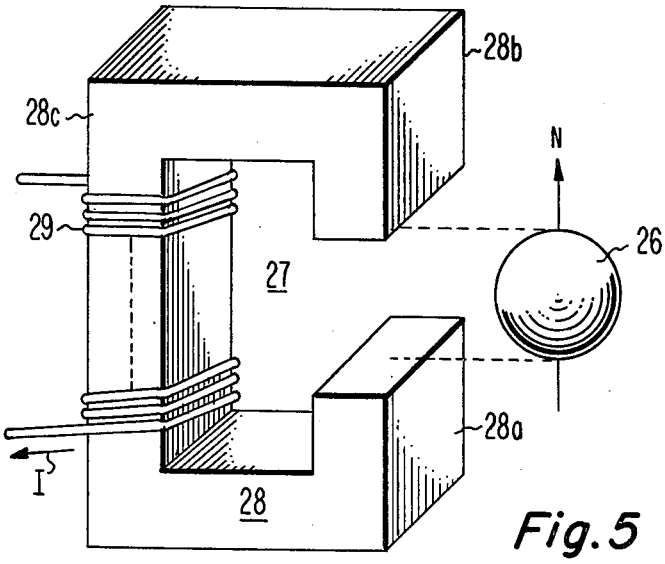
FIG. 5 illustrates a magnetizing unit used to magnetize each of the electron beam moving structures of FIG. 1.

Sphere 26, for example, is magnetized across a diameter by a conventional magnetizing unit 27, as illustrated in FIG. 5. Magnetizing unit 27 comprises a rectangular core 28 of ferromagnetic material. A solenoidal coil 29 is wound around a leg 28*c*. The unmagnetized sphere 26 is introduced in a gap 28*b* in an opposite leg 28*a* and a magnetizing current pulse, I, is coupled to magnetizing coil 29.

If a positive current pulse is coupled to coil 29 in the direction of the arrow of FIG. 5, sphere 26 is magnetized with a north pole located in the upper hemisphere of the sphere and a south pole located in the lower hemisphere. The two poles are separated along a polar axis 126. A substantially two-pole magnetic field is produced by the now magnetized sphere 26.

The two-pole magnetized sphere 26 may be used to provide electron beam motion to correct for beam landing errors, such as static convergence error. With sphere 26 placed adjacent outer electron beam 23, as illustrated in FIG. 1, the motion of beam 23 is influenced by the two-pole magnetic field produced by sphere 26. Beam 23 will be moved in the horizontal or X-direction and in the vertical or Y-direction by the transverse components of the magnetic field of sphere 26. Any field component parallel to the longitudinal motion of electron beam 23, that is, any component parallel to the longitudinal of Z-axis of the cathode ray tube, will produce no transverse electron beam motion. Thus for sphere 26 to provide for zero strength or no motion to electron beam 23, the polar axis 126 of magnetized sphere 26 is aligned parallel to the longitudinal electron beam 23 travel or parallel to the Z-axis of the tube, as illustrated in FIG. 1.

Figure 2:
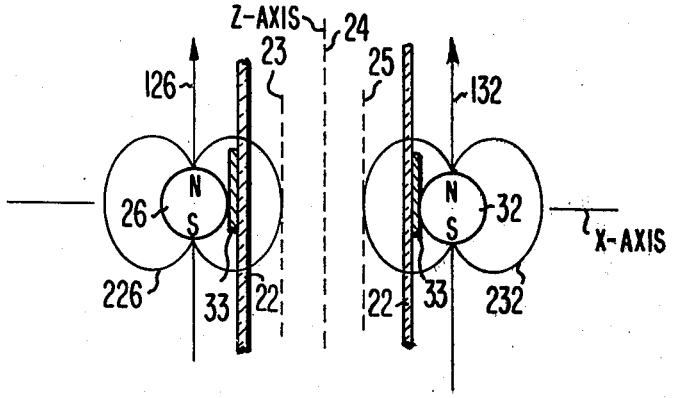
FIGS. 2–4 schematically illustrate the effect on electron beam motion of the beam moving fields of the electron beam moving structures of FIG. 1, with the structures oriented in various rotational positions.

With polar axis 126 aligned parallel to the Z-axis, the two-pole magnetic field 226 is oriented as schematically illustrated in FIG. 2. Because of the field symmetry, at the locations along the travel of electron beam 23, the net transverse electron beam movement produced by the transverse components of magnetic field 226 is substantially zero. That is to say, the effective resultant transverse field component is zero, and relatively insubstantial net transverse motion results.

Figure 3:
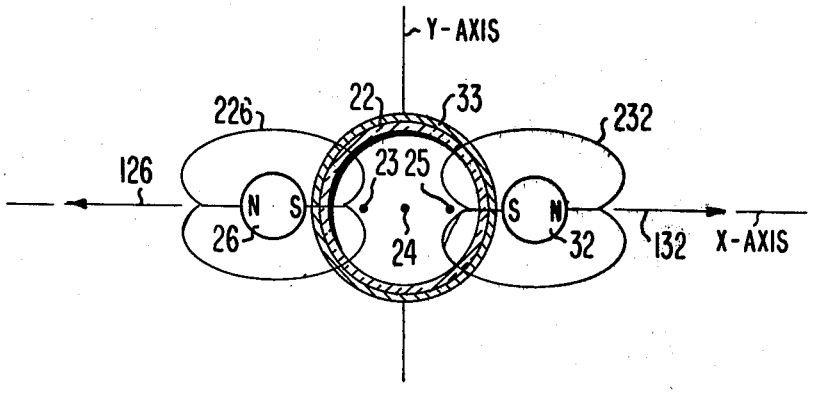

To provide vertical correction motion to electron beam 23, sphere 26 is rotated such that polar axis 126 rotates in a horizontal plane, in a horizontal direction, along the arrow 30, as illustrated in FIG. 1. As polar axis 126 is rotated out of longitudinal alignment, a resultant or effective horizontal field component, intersecting the electron beam 23 travel, is introduced by magnetic field 226. This horizontal component produces a vertical correction motion. Maximum vertical correction motion is provided when polar axis 126 is parallel to the horizontal or in-line X-axis of the cathode ray tube, as illustrated in FIG. 3.

Figure 4:
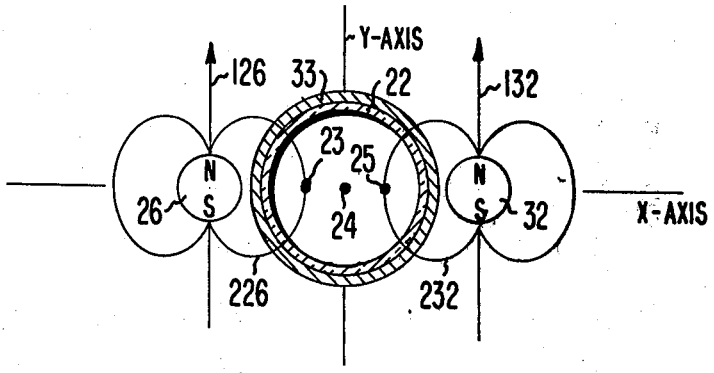

Similarly to provide horizontal correction motion to beam 23, polar axis 126 is rotated out of longitudinal alignment in a vertical plane, in a vertical direction, as illustrated by the arrow 31 of FIG. 1, thereby providing a resultant or effective vertical component of magnetic field 226 that intersects the electron beam travel. Maximum horizontal correction motion is provided when polar axis 126 is parallel to the vertical or Y-axis of the cthode ray tube, as illustrated in FIG. 4.

By combining rotation of polar axis 126 of sphere 26 in the horizontal and vertical planes, either simultaneously or sequentially, any direction and strength of motion to outer electron beam 23 is made possible.

To provide for correction motion of the other outer electron beam 25, the second magnetic field producing structure 32 comprising the second magnetized sphere is located adjacent outer electron beam 25 on the side of neck 22 away from the first sphere 26, as illustrated in FIG. 1. Sphere 32 is magnetized in a manner similar to sphere 26, with a north and south pole separated across a diameter along a polar axis 132, producing a magnetic field 232, as illustrated in FIGS. 2–4. To provide no or insubstantial transverse motion, polar axis 132 is aligned with the longitudinal axis of the cathode ray tube, as illustrated in FIG. 2, thereby providing no resultant or effective transverse field component. To provide vertical correction motion only, polar axis 132 is rotated horizontally in a horizontal plane into alignment with the horizontal or X-axis, as illustrated in FIG. 3, and to provide horizontal correction motion only, polar axis 132 is rotated vertically in a vertical plane into alignment with the vertical or Y-axis, as illustrated in FIG. 4. By cooperatively rotating spheres 26 and 32, any transverse motion to the outer electron beams is provided, thereby providing for a supplemental static convergence capability.

The magnetic field of a sphere is less intense at points farther away from the center of the sphere. Thus, the greatest motion is produced on the electron beam nearest the sphere. For example, with sphere 26 oriented as illustrated in FIG. 4, the greatest horizontal motion is exhibited on outer electron beam 23, as required. Some undesirable horizontal motion, however, may be exhibited by electron beams 24 and 25. Any undesired motion on outer electron beam 25 produced by rotation of sphere 26 may be compensated by appropriate rotation of the other magnetized sphere. By cooperative rotation of both spheres, compensation for the undesired motion of the outer beams may be achieved when correcting for static misconvergence.

Because both spheres typically are rotated to compensate for undesired motion, the rotation of each sphere moves, to a certain extent, the center beam in a direction opposite to that produced by rotation of the other sphere. Thus, the net undesired motion of the center beam will be substantially reduced. In fact, many statically misconverged color cathode ray tubes have the outer electron beams generally symmetrically displaced from the center beam. Converging the other beams onto the center beam will result in no significant net motion of the center beam. If some purity error is introduced in the supplemental static convergence correction, a conventional two-pole purity ring pair may be used to provide a supplemental purity correction field, as will be described below.

Figure 10:
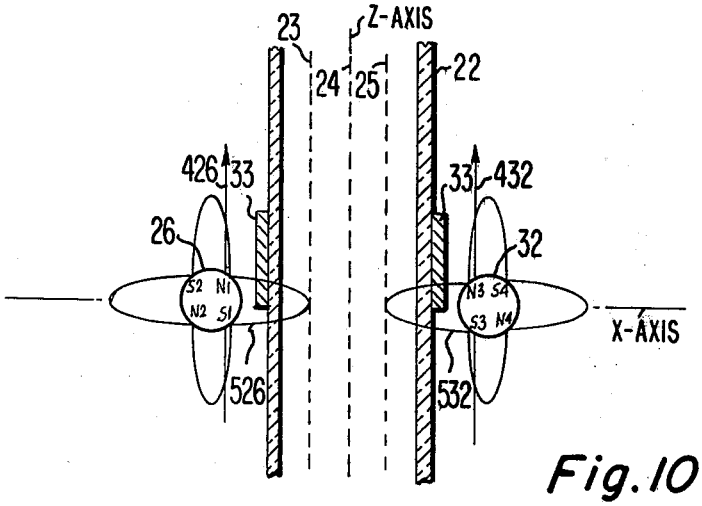
FIG. 10 schematically illustrates the effect on electron beam motion of the beam moving fields of electron beam moving structures magnetized in four-pole configurations.

Spheres 26 and 32 may be magnetized in multipole configurations other than the two-pole configuration previously described. For example, as illustrated in FIG. 10, spheres 26 and 32 may be magnetized to obtain four poles, N1, S1, N2, S2, for sphere 26 and N3, S3, N4, S4 for sphere 32, thereby creating four-pole fields 526 and 532. The polar axes to be rotated are no longer those across a diameter but any of the ones that separates a north and south pole. For example, for sphere 26, polar axis 426 separating poles N1 and S1 may be used and for sphere 32, polar axis 432 separating poles N3 and S3 may be used. As illustrated in FIG. 10, with polar axes 426 and 432 longitudinally aligned, substantially no net transverse motion of the electron beams result. Rotating these polar axes in horizontal and vertical planes will produce resultant static convergence correcting transverse component magnetic fields in a manner similar to that previously described for the two-pole magnetized spheres. An advantage of the four-pole configuration may be that the rate of decrease of magnetic field intensity with distance from the center of a magnetized sphere is greater for a four-pole configuration than for a two-pole configuration. Less undesirable motion is exhibited by the farther away electron beams.

Figure 6:
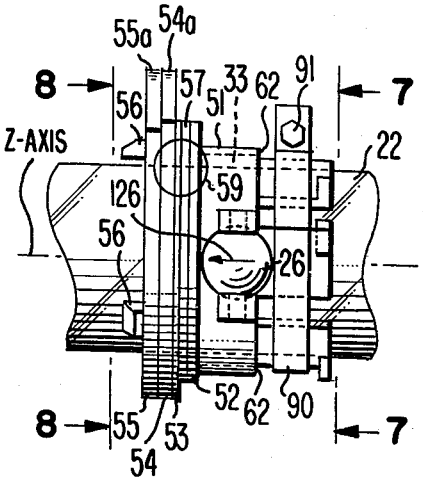
FIG. 6 illustrates a side elevation view of a static convergence and purity assembly, embodying the invention.
Figure 7:
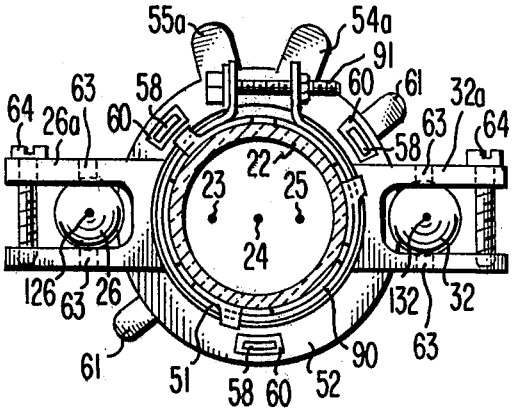
FIG. 7 illustrates a cross-sectional view of the assembly of FIG. 6 along the line 7—7.
Figure 8:
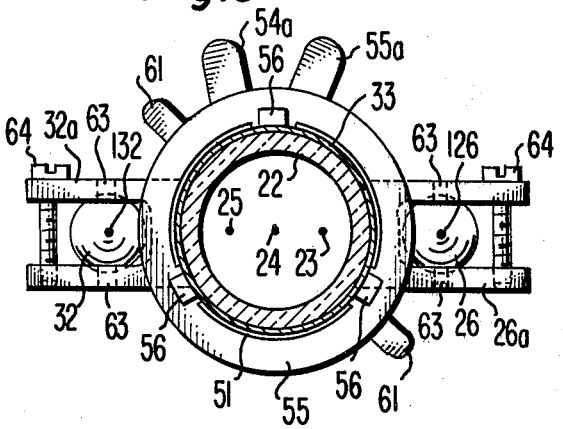
FIG. 8 illustrates a cross-sectional view of the assembly of FIG. 6 along the line 8—8.

FIGS. 6–8 illustrates various elevation views of static convergence and purity magnetic assembly 50, embodying the invention. As illustrated in FIGS. 6–8, magnetic spheres 26 and 32 are located by means of an annular support housing 51, adjacent their respective outer electron beams 23 and 25. A flange 52 is formed near one end of support housing 51.

Adjacent one side of flange 52 is located a ring collar 57, then a paper washer 53, and then a two-pole purity ring pair comprising rings 54 and 55. Tabs 54*a* and 55*a* formed in rings 54 and 55 permit rotation of the rings about neck 22. Rings 54 and 55 provide a conventional interior two-pole purity correcting magnetic field as described in the aforementioned U.S. patent of R. L. Barbin. Should any purity errors be introduced after magnetic strip 33 is affixed to neck 22 and magnetized, these rings may then be rotationally adjusted to provide a supplemental purity correcting field.

Figure 9:
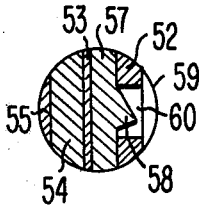
FIG. 9 illustrates on a magnified scale, an encircled portion of the assembly of FIG. 6.

To retain rings 54 and 55 on support housing 51, projections 56 with outwardly hooked ends are formed in the end of support housing 51 adjacent rings 54 and 55. The hooked ends of projection 56 contact one side of ring 55, as illustrated in FIGS. 6 and 8. In flange 52 are formed three apertures 60, for example, as illustrated in FIG. 7 and in FIG. 6 by the encircled breakout view portion 59. Encircled portion 59 is illustrated in FIG. 9 on a magnified scale. Three corresponding ramp protrusions 58 are formed in the side of ring collar 57 adjacent flange 52. Tabs 61 formed in ring collar 57 provide for rotation of the collar about neck 22.

With tabs 61 of ring collar 57 positioned in the unlocked position, as illustrated in FIG. 9, ramp protrusions 58 of ring collar 57 are positioned entirely within apertures 60 of flange 52. Purity rings 54 and 55 are loosely held between hooked projections 56 and flange 52. The purity rings are, therefore, unlocked and may be easily rotated. After the purity rings are rotationally adjusted to supplementarily correct for any redeveloped purity error, the rings are locked into place by rotating ring collar 57. The edges of apertures 60 ride up on the ramp portions of protrusions 58, thereby pressing ring collar 57 against purity rings 54 and 55 and locking them into place against hooked projections 56. A ramp locking arrangement similar to that just described is disclosed in U.S. Pat. No. 4,032,872 of J. K. Kratz et al. entitled "BEAM ADJUSTMENT ASSEMBLY FOR A CATHODE RAY TUBE."

Assembly 50 is slipped over magnetized strip 33. A step 62 is formed in the wall of support housing 51 of assembly 50 and functions as a stop for correctly positioning purity rings 54 and 55 and magnetized spheres 26 and 32 over magnetized strip 33.

To permit rotation of magnetized spheres 26 and 32, two C-shaped detents 26*a* and 32*a* are formed in opposite sides of support housing 51, into which detents are respectively placed spheres 26 and 32. To provide a bearing surface, holes 63 are formed in opposite legs of each detent and into which the spheres are nestled. These holes have beveled entries to prevent sharp edges from cutting into spheres.

Using detents 26*a* and 32*a*, magnetized spheres 26 and 32 may be rotated in any direction by hand manipulation of the spheres, for example. Spheres 26 and 32 may, for example, each be magnetized to create a two-pole field, as described proviously, with a north and south pole of sphere 26 separated along a diameter or a polar axis 126 and a north and south pole of sphere 32 separated along a diameter or a polar axis 132.

Detents 26*a* and 32*a* permit spheres 26 and 32 to be rotated such that polar axes 126 and 132 are aligned with the longitudinal or Z-axis of the cathode ray tube, as illustrated in FIGS. 6–8. In such an orientation, no substantial resultant or effective transverse magnetic field exists along the direction of travel of the electron beams and no net transverse forces and movements are impressed.

To produce a transverse magnetic field and a transverse movement of the electron beams to supplementarily correct for any redeveloped static misconvergence, sphere 26 and 32 are freely rotated, simultaneously if desired, in both horizontal and vertical planes, until the orientations of the spheres produce the required correcting beam motion. Once the correct orientations are achieved, screws 64, located in threaded holes at ends of detents 26*a* and 32*a*, are tightened, thereby locking the spheres into place.

It should be noted that magnetic assembly 50 may be used without other magnetic devices to provide any of the required correcting beam motions. For some manufactured color cathode ray tubes for those, for example, which usually develop only minor errors, assembly 50 may be used without using other purity and static convergence devices or assemblies.

A clamp 90 and screw 91 are provided at one end of the tubular portion of housing 51 to clamp the housing against neck 22.

What is claimed is:

1. An electron beam moving apparatus for a color cathode ray tube, with three in-line electron beams located within the envelope of said cathode ray tube, said electron beams traveling along the longitudinal axis of said cathode ray tube, comprising:

a first magnetic field producing structure with at least two magnetic poles separated along a first polar axis;

a support housing for locating said first magnetic field producing structure adjacent a first outer electron beam of said three in-line electron beams; and first means for rotationally securing said first magnetic field producing structure for permitting alignment of said first polar axis with said longitudinal axis and for permitting rotation of said first polar axis away from alignment with said longitudinal axis in both horizontal and vertical planes.

2. Apparatus according to claim 1 including a second magnetic field producing structure with at least two magnetic poles separated along a second polar axis, said second magnetic field producing structure located by said support housing adjacent a second outer electron beam of said three in-line beams, and second means for rotationally securing said second magnetic field producing structure for permitting alignment of said second polar axis with said longitudinal axis and for permitting rotation of said second polar axis away from alignment with said longitudinal axis in both horizontal and vertical planes.

3. Apparatus according to claim 2 wherein said first and second magnetic field producing structures cooperate to provide static convergence of at least the outer electron beams of said three in-line electron beams.

4. Apparatus according to claim 3 wherein each of said first and second rotationally securing means comprises a detent for permitting rotation in any direction of an associated sphere of magnetic material.

5. An electron beam moving apparatus for a color cathode ray tube, with three in-line electron beams located within the envelope of said cathode ray tube, said electron beams traveling along the longitudinal axis of said cathode ray tube, comprising:

a first magnetic field producing structure including a sphere of magnetic material magnetized across a diameter with at least two magnetic poles separated along a first polar axis;

a second magnetic field producing structure including a sphere of magnetic material magnetized across a diameter with at least two magnetic poles separated along a second polar axis;

a support housing for locating said first and second magnetic field producing structures adjacent respective first and second outer electron beams of said three in-line electron beams;

first means for rotationally securing said first magnetic field producing structure for permitting alignment of said first polar axis with said longitudinal axis and for permitting rotation of said first polar axis away from alignment with said longitudinal axis in both horizontal and vertical planes; and second means for rotationally securing said second magnetic field producing structure for permitting alignment of said second polar axis with said longitudinal axis and for permitting rotation of said second polar axis away from alignment with said longitudinal axis in both horizontal and vertical planes, said first and second magnetic field producing structures cooperating to provide static convergence of at least the outer electron beams of said three in-line electron beams.

6. An electron beam moving apparatus for a color cathode ray tube, with three in-line electron beams located within the envelope of said cathode ray tube, said electron beams traveling along the longitudinal axis of said cathode ray tube, comprising:

a first magnetic field producing structure including a sphere of magnetic material magnetized in a four-pole configuration with at least two magnetic poles separated along a first polar axis;

a second magnetic field producing structure including a sphere of magnetic material magnetized in a four-pole configuration with at least two magnetic poles separated along a second polar axis;

a support housing for locating said first and second magnetic field producing structures adjacent respective first and second outer electron beams of said three in-line electron beams;

first means for rotationally securing said first magnetic field producing structure for permitting alignment of said first polar axis with said longitudinal axis and for permitting rotation of said first polar axis away from alignment with said longitudinal axis in both horizontal and vertical planes; and second means for rotationally securing said second magnetic field producing structure for permitting alignment of said second polar axis with said longitudinal axis and for permitting rotation of said second polar axis away from alignment with said longitudinal axis in both horizontal and vertical planes, said first and second magnetic field producing structures cooperating to provide static convergence of at least the outer electron beams of said three in-line electron beams.

7. Apparatus according to claims 5 or 6 wherein each of said first and second rotationally securing means comprises a detent for permitting rotation in any direction of an associated sphere of magnetic material.

* * * * *